US005916063A

United States Patent [19]

Alessandri

[11] Patent Number: 5,916,063

[45] Date of Patent: Jun. 29, 1999

[54] PORTABLE MEMORY-MEDIATED SYSTEM AND METHOD FOR PROVIDING CUSTOMIZED TRAINING PROGRAM FOR USER OF PLURAL UNITS OF EXERCISE APPARATUS

[75] Inventor: Nerio Alessandri, Longiano, Italy

[73] Assignee: Technogym S.R.L., Gambettoia, Italy

[21] Appl. No.: 08/539,408

[22] Filed: Oct. 5, 1995

[30] Foreign Application Priority Data

Oct. 7, 1994 [IT] Italy ..... B094A0440

[51] Int. Cl.[6] ..... A63B 21/00

[52] U.S. Cl. ..... 482/4; 482/1; 482/9; 482/901

[58] Field of Search ..... 482/1–9, 900–902

[56] References Cited

U.S. PATENT DOCUMENTS 4,642,769 2/1987 Petrofsky .
4,907,795 3/1990 Shaw et al. .
5,410,472 4/1995 Anderson .

FOREIGN PATENT DOCUMENTS 90-08361 7/1990 WIPO .
94-10634 5/1994 WIPO .

*Primary Examiner*—Jerome Donnelly
*Assistant Examiner*—Glenn E. Richman
*Attorney, Agent, or Firm*—IP Group of Pillsbury Madison & Sutro LLP

[57] ABSTRACT

A system for programming training on exercise apparatus, with a series of exercises defining a personalized program, includes a central unit with first processor and a bi-directional data transferor; a portable medium, with a portable memory for data storage; a plurality of stations, not connected to one another by a data transmission line, and located at the exercise apparatus, with a second processor and a bi-directional data transferor from and to the portable medium, so as to receive as input the data in the portable memory relative to the exercise to be performed on an individual apparatus, for programming the apparatus, and so as to transfer as output to the portable memory upon completion of the exercise, data relative to the performance of the exercise so as to allow such data to be controlled. The first processor, after receiving from the portable medium the actual data for an exercise just completed, through the bi-directional data transferor of the central unit, being capable of modifying the program in accordance with the actual data received.

6 Claims, 2 Drawing Sheets

PORTABLE MEMORY-MEDIATED SYSTEM AND METHOD FOR PROVIDING CUSTOMIZED TRAINING PROGRAM FOR USER OF PLURAL UNITS OF EXERCISE APPARATUS

BACKGROUND OF THE INVENTION

The present invention relates to a system for programming training on exercise apparatus.

In particular, the system disclosed can be used to advantage in sport-recreational structures such as gymnasiums, fitness centers, sports clubs, rehabilitation centers, clinics and similar locations.

In such structures (for the purpose of simplicity hereinafter referred to as gyms), users are supposed to perform a series of exercises or rehabilitative movements differentiated according to parameters relative to the type of training or rehabilitation, the user's physique and state of health, the objectives to be reached, etc.

Each user or athlete is assigned a specific program to be followed during the various training sessions. The programs differ according to the number of exercises, the order in which they are to be performed, their length and intensity.

To this end, at the gym, once the instructor has evaluated the athlete's physical characteristics and the objectives to be reached, he or she prepares an exercise "routine", clearly indicating to the athlete the way in which these exercises must be performed.

The resulting routine is the athlete's program, and is accompanied by a written schedule which the athlete must carry during training for the necessary consultation during performance of the exercises.

The programs normally prepared relate to lengthy periods of attendance at the gym and, in any case, cannot be altered upon each visit for obvious organizational reasons, so that, in brief, for each cycle the athlete substantially repeats the same exercises.

The program is generally set as a kind of average between the initial training stage (during which the athlete is more likely to be less trained) and the final result for each cycle.

For this reason, it is possible that during the initial stage the athlete trains more intensively than necessary. While during the final stage of each cycle, the exercises do not stretch the athlete's actual physical abilities to the full.

With programs of this type it is, therefore, impossible to constantly correlate the intensity of the training and the athlete's actual condition. This is of fundamental importance, since training which is hyper or hypo intensive may not be of use to the athlete and, in some cases, may even have negative consequences.

Exercise machines are currently available which are able to interact with feedback from the athlete relative to the latter's physiological parameters (e.g.: heart rate) varying the intensity of an exercise in accordance with the feedback. However, the repeated use of such machines does not provide identical results.

Moreover, there is no link between exercises performed on different machines, because it is impossible to compare the data relative to exercises performed on more than one machine.

At present, it is impossible to prepare a program for a series of exercises based on the athlete's actual reactions to the training, relative to the exercise and physical effort involved.

SUMMARY OF THE INVENTION

The object of the present invention is to overcome the afore-mentioned disadvantages with a system for programming training on exercise apparatus, designed to provide a training or rehabilitation program which may be varied in accordance with the results achieved, that is to say, according to the performance of the various series of exercises to be performed during training sessions. The system of the present invention, in a preferred implementation, connects all of the exercise apparatus present in a gym to a central unit for the programming of the training to be effected, and allows the storage and even a graphic display of previous training.

The system of the present invention includes a central unit for the development of a training program to be performed on a plurality of exercise apparatus, the exercise apparatus possibly having a plurality of stations to allow the exercises to be set on them, as well as to receive feedback relative to the exercises performed.

The interface between the central unit and the stations is a portable memory contained in a medium designed to interact with the central unit and stations with suitable bi-directional data transmission means.

The use of the portable memory as the training program's portable medium may also determine various means of access to other activities linked to the gym or sports center. For example, the portable memory may be used to control access, as a means of payment, as a key for library references, to check attendance, etc.

BRIEF DESCRIPTION OF THE DRAWINGS

The technical features of the present invention, in accordance with the above-stated object and the advantages of the invention are more clearly described in the detailed description below, with reference to the accompanying drawings which illustrate an embodiment by way of example only, and in which.

DESCRIPTION OF THE PREFERRED EMBODIMENTS

With reference to the accompanying drawings, the system for programming training on exercise apparatus of the present invention is of the type which may be used for training or rehabilitation based on the performance, using a plurality of exercise apparatus, of a series of exercises defining a personalized program.

Figure 1:
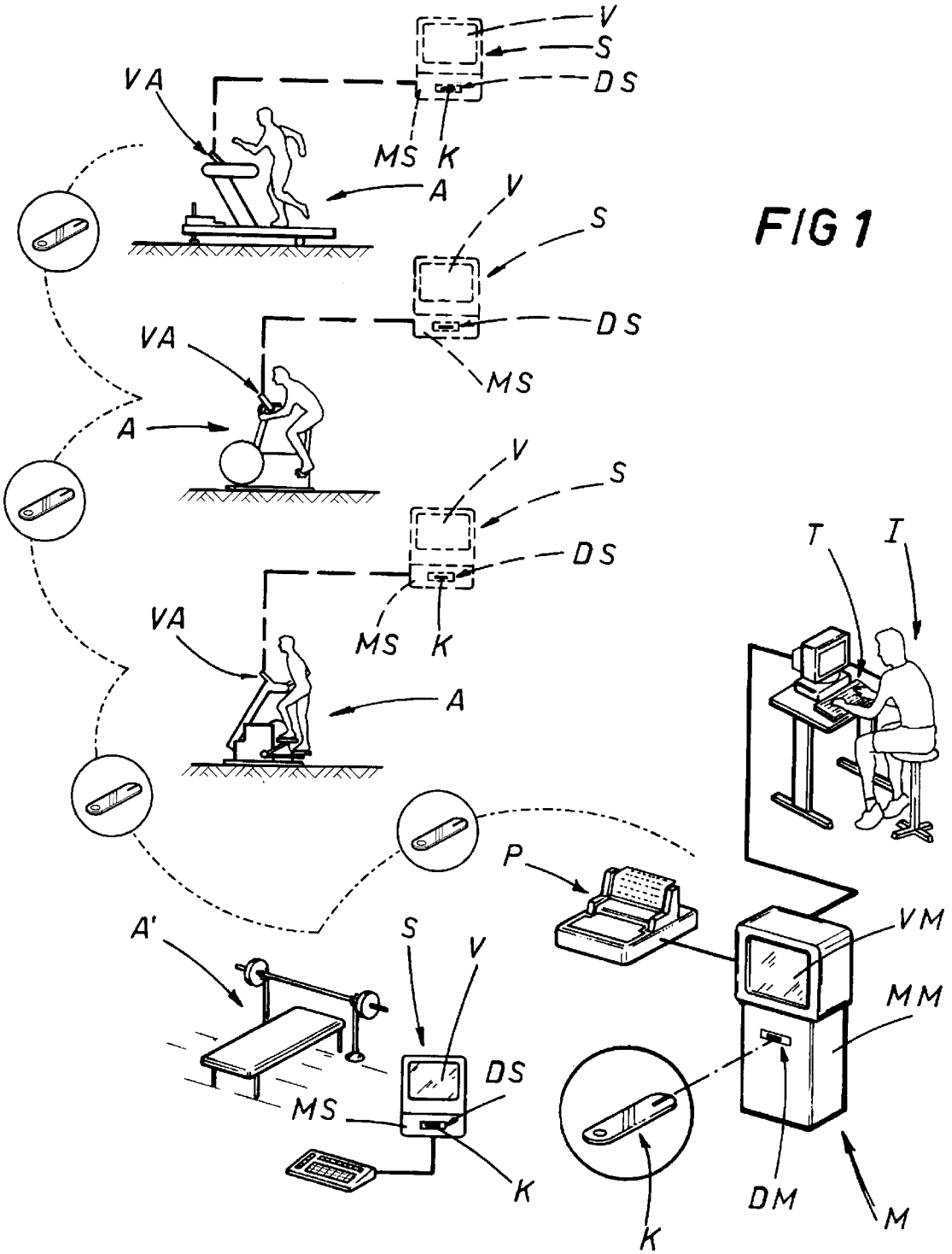
FIG. 1 is a schematic illustration of an embodiment of the present invention.

In FIG. 1, where the various elements of the system are not shown in proportion (for the purpose of greater clarity,) such exercise apparatus are schematically represented by machines A for the performance of exercises which may be compared, respectively, to cycling, running, stepping (technically known as "bike", jogging machine and "step"), as well as a conventional bench A' for weight lifting with a bar.

The system includes a central unit M with first processing means MM and bi-directional data transfer means DM. The central unit M has means which may be used to write and read data relative to the personalized program, as well as to modify the program itself.

The processing means MM may be a personal computer with suitable software for the programming of personalized training. The bi-directional data transfer means DM, connected to the processing means MM, are suitable devices for writing to and reading from a portable memory, designed to transfer data between apparatus units which are not directly connected.

The portable memory is located on a portable medium K and stores the data relative to the afore-mentioned personalized program.

The system also includes a plurality of stations S, located at the corresponding plurality of exercise apparatus units A, A'.

The stations S, like the central unit, have second processing means MS and means DS for the bi-directional transfer of data from and to the portable medium K, so that they receive, as input, the data present in the memory relative to the exercise to be performed in order to define the programming of the apparatus, and to transfer as output to the portable memory, upon completion of the exercise, data relative to the exercises and physical effort exerted in order that they be controlled.

The first processing means and bi-directional data transfer means DM, otherwise known as the central unit, can modify the personalized program according to the data received when the exercises are performed.

Obviously, the second processing means MS in the stations S need not process or reset the personalized program, since it is sufficient that they be able to read the data from the portable medium K and transmit to the latter the data relative to the exercises and physical effort exerted.

The central unit M is best installed in an easily accessible area of the gym and may take the form of a multi-media station, of the type used, for example, in arts centers, stations or airports, equipped, for example, with "touch screen" type user interface devices to facilitate reference.

The various exercise apparatus units A, A' are not connected directly to the central unit M. This avoids the need for electrical or other connections, allowing the machines to be placed at any distance from the central unit, so that the system can be used in gyms or centers spread over more than one story, or over an extensive area.

The connection between the central unit M and apparatus units A, A', created by means of the portable medium K, may consist of an electronic key K (for example, with an $E^2$PROM type memory) which allows communication between the central unit M and the stations S.

The electronic key K may have a plastic cover designed to render it waterproof. The combination of a memory programmed through magnetic induction and a waterproof cover allows, on one hand, memory programming without the need for contacts, and on the other, allows easy use of the electronic key K even in environmental conditions which have negative effects on other program media, e.g., the presence of humidity.

The stations S each may have a respective monitor V to display the exercises to be performed, and may vary according to the corresponding machines or apparatus.

For example, exercise machines which require electronic programming (such as the bike, jogging machine and step, denoted by A in FIG. 1) can be linked to stations S connected directly to the controls for the respective apparatus units, or the stations S may form part of those controls. In this way, the apparatus units are "set" directly with the data obtained from the portable memory.

There may also be means which automatically detect the exercise and physical effort exerted, designed to control the exercise and physical effort exerted, providing the said respective data as output which may be used by the central unit M.

The displays VA shown provided on the respective exercise apparatus units may be used to display the program instead of the monitors V on the stations S.

In FIG. 1, the stations S linked to electronically programmed exercise apparatus units are shown by respective lines broken, since they may, as described above, be incorporated in the exercise apparatus units.

For the exercise apparatus units which do not require automatic programming, such as the isotonic machines or weights (in FIG. 1 represented by the bench A'), the data relative to the exercise and physical effort exerted can be entered "manually" using the keyboard T', or using the touch screen type monitor V.

At or connected to the central unit M by means, for example, of a local area network (LAN), are manual data entry means T, which may consist of a keyboard. The keyboard T can be used by the instructor I to provide the first processing means MM (and, therefore, also the bi-directional data transfer means DM) with data about the athlete for the composition of the personalized program.

The description below illustrates some possible ways of using the system disclosed.

The first time a person goes to a gym, following an initial interview (accompanied, if necessary, by a medical examination) during which the objectives of the training are established, the portable memory K is "loaded" with a training schedule defined by the afore-mentioned data which form a set of instructions that can be read by the stations S positioned at the exercise apparatus units A, A'.

During subsequent training sessions, the portable medium K is inserted in the reading device defined by the first bi-directional data transfer means DM so as to receive instructions relative to the training for that particular day.

When the user arrives at an exercise apparatus unit, if it is of the type A, provided with the capability of automatic programming, he/she inserts the electronic key K in the purpose-designed reading device on the station S linked to the exercise apparatus unit, thus "setting" the exercise apparatus unit, so that he/she then simply goes ahead with the training. Upon completion of the training, the station S "unloads" the data relative to the exercise and physical effort exerted onto the key K.

In the case of exercise apparatus units with manual programming (see bench A' in FIG. 1) the user inserts the electronic key K in the station S reading device and the monitor V displays the type of exercises, their order, repetitions and relative weights. Upon completion, the user must confirm whether the training corresponded to that suggested, or specify any variations, so that all data may be stored on the electronic key K.

In both cases, for exercise apparatus units with automatic or manual control, following storage of data about the exercise and physical effort exerted, the station S monitor V may indicate the next exercise to be performed.

At the end of the training session, the individual goes to the central unit M to "unload" the electronic key K and enter in a memory, with first processing means MM, the feedback on the exercise and physical effort exerted. The final operation may envisage an indication which immediately reveals the quality of the exercise and physical effort exerted, thus assessing the benefits of the training session.

When the data is entered in the central unit, as well as facilitating the management of various schedules for a number of days' training, it is possible to control the training sessions effected by a user, set out timetables, types of exercises, analyze user attendance, etc.

The user interacts with the central unit by means of the electronic key K, as described above, loading the data relative to training and unloading the data about the exercise and physical effort exerted, and may, in some cases, interact using a touch screen-type device.

Figure 2:
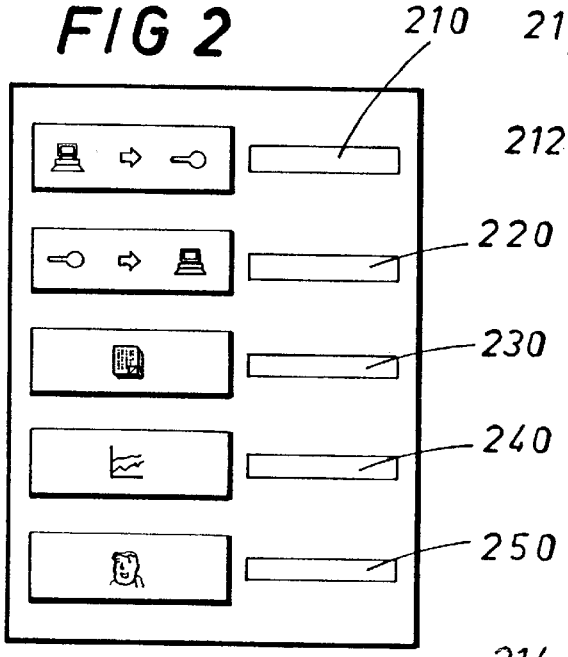
FIGS. 2, 3, 4, 5, 6, and 7 are schematic illustrations of possible graphic representations of the set-up and layout of a training program provided in accordance with the principles of the present invention.

Following the insertion of the electronic key K and/or the pressure of a fingertip on the screen VM (in the case of "touch screen" devices) on the central unit M, a screen page showing the main menu appears, similar to that illustrated in FIG. 2.

The main menu is divided into a series of icons 210, 220, 230, 240, 250 which correspond with the various functions of the main program. When the user touches one of the icons displayed on the screen, the program allows access to the selected environment which is described below.

The last icon or box 250 illustrated in FIG. 2 relates to the programs used only by the instructors to set training routines and enter various data.

One of the functions of the main program is the training load program (corresponds to box 210 in FIG. 2), which allows the training to be performed by the user to be loaded onto the electronic key K. The user employs this function each time he/she enters the gym and decides to begin training. While the electronic key K is loaded, the training schedule and/or the user's progress relative to the objective set may appear on the display.

Figure 3:
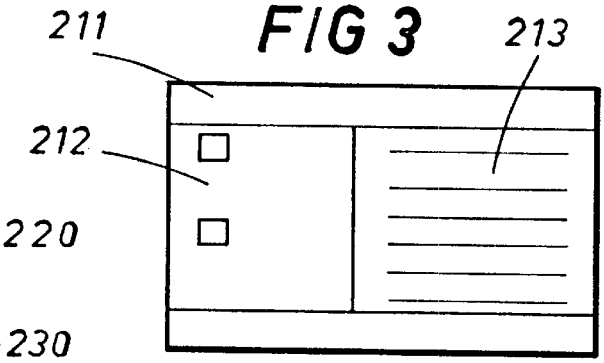

The training schedule may resemble that shown in FIG. 3, where the athlete's name appears in one sector 211 of the screen. While another two sectors 212 and 213 respectively show the various exercises for the training session and the way in which they must be performed.

As well as being displayed on the central unit M screen VM, the training schedule can be printed out as hard copy, by means of a printer P connected to the central unit.

Figure 4:
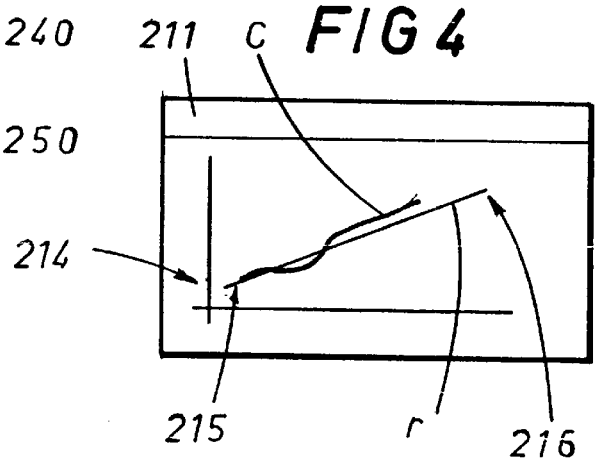

The user's progress may be displayed as shown in FIG. 4, where a graph 214 is used, the X-axis representing the time, and the Y-axis the level of fitness.

On the graph 214, a straight line r connects a first point 215, corresponding to the condition at the start of the training period, and a second point 216, relative to the athlete's ultimate objective. A curve c is superimposed on the straight line r, and shows the athlete's actual progress over the same period of time.

Another function of the main program is the unloading of training data. The user accesses this environment (corresponding to box 220 in FIG. 2) at the end of each training session. During this stage, the results of training, stored by the stations S on the electronic key K, are unloaded to the console and a graph may appear on the screen VM, allowing immediate evaluation of the exercise and physical effort exerted.

Figure 5:
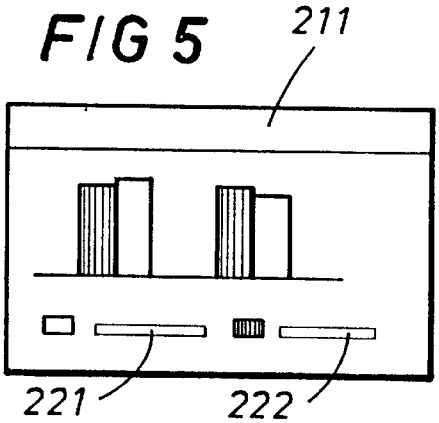

The image may resemble that shown in FIG. 5 and can be displayed using the command denoted by 230 in FIG. 2, which is a training schedule display function.

In FIG. 5, where the athlete's name appears in the top sector 211, the training schedule loaded on the electronic key K is displayed, and for each type of exercise in the schedule (there being two in the example) there is an indication as to whether it has been performed (222), or not (221). The next exercise to be performed may also be indicated. The training schedule may be displayed at any moment and can be printed by the user if so required.

Figure 6:
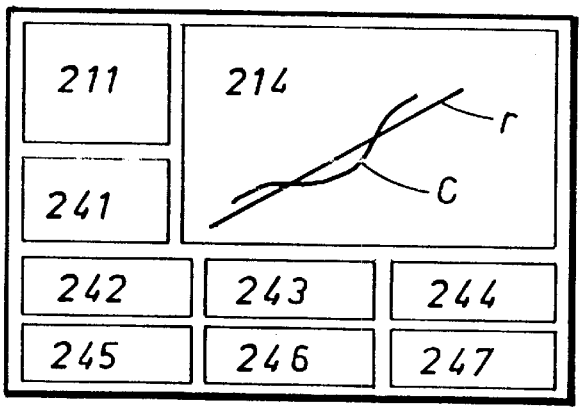

Another option in the main menu is to display the exercise and physical effort exerted by selecting box 240 in FIG. 2, allowing the display of data which has been archived, the image resembling that shown in FIG. 6.

The graph 214 on the top right is the same as that in FIG. 4 previously described, which shows the user's progress toward the objective set, with the relative reference straight line r and the curve c showing the actual exercises and physical effort exerted.

The individual's personal name and surname appear in the top left corner of box 211, together with other data such as his/her date of birth and weight. By selecting this icon it is possible to access a window which allows modification of the weight if necessary.

Box 241, lower down, is available for user information.

The remaining icons 242, 243, 244, 245, 246, 247 can be used to display data relative to the various exercises performed, or for various kinds of comparisons.

For example, boxes 242, 243, 244, 245, and 246 may display, respectively, the kilometers totaled on the "bike", the total number of floors covered on the "step", the kilometers totaled on the "jogging machine", the total kilograms lifted on isotonic machines, and the total kilo calories used.

Figure 7:
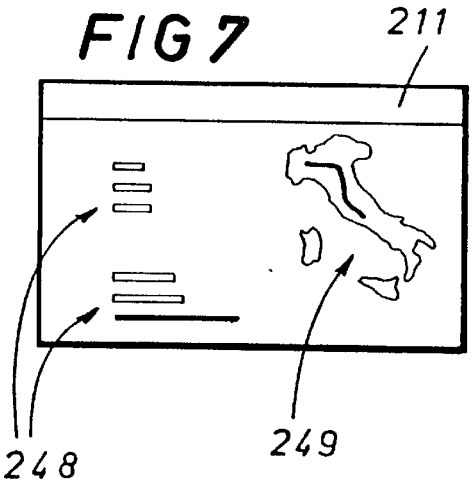

When an icon is selected, a screen page appears, showing the relative data with graphics similar to those illustrated in FIG. 7, for example, for "bike" training.

Similarly to the illustrations in FIGS. 3, 4 and 5, the graphics in FIG. 7 show the athlete's name at the top in area 211. While the kilometers totaled during training are shown at the side in area 248, these kilometers being divided into training periods, there being, at the side, a graphic indication in area 249 of the kilometers totaled relative to a known reference value (e.g.: a map of Italy, upon which the kilometers totaled are shown by a line starting at a known location). Box 247, for comparisons, allows the graphic comparison of the user's performance relative to all other members of the gym and/or a given reference group.

Because the word apparatus is used as both a singular and a plural in contemporary American English, and because all machines are commonly understood to be apparatus, but not all apparatus are commonly understood to be machines, the term exercise apparatus unit has been used herein to generically designate respective the apparatus collocated with each station.

Obviously, as already stated, the present description illustrates only some of the possible uses of the system disclosed, without limiting other possible applications which may be obtained through modification of the main program software, or the possibilities offered by the menu.

The present invention, thus designed for the stated object, may be subject to numerous variations, all encompassed by the original design concept, and all components may be replaced with technically equivalent parts.

What is claimed is :

1. A system for providing programmed training or exercise apparatus, comprising:

a plurality of exercise apparatus units disposed at respective exercising sites;

a portable medium having a portable memory for storing instructions and performance data relative to a personalized program which includes a series of exercises performed or to be performed by a respective user by use of said exercise apparatus units;

a central unit disposed at a site remote from said exercising sites and operative independently of said exercise apparatus unit, said central unit having a first processor, and a first bi-directional data transfer means operatively associated with said first processor, for writing and reading data relative to said personalized program, and for initiating and modifying the instructions of said program; said first bi-directional data means being arranged to read data from and write data to send portable memory upon occurrence of removable association of said portable medium with said first bi-directional data transfer means;

a plurality of stations, each collocated with a respective one of said exercise apparatus units;

each of said stations including a second processor and a second bi-directional data transfer means operatively associated with the respective said second processor, for writing and reading data relative to said personalized program; each said second bi-directional data transfer means being arranged to read instruction data from and write performance data to said portable memory relative to the respective exercise apparatus unit upon occurrence of removable association of said portable medium with the respective said second bi-directional data transfer means, for providing as input to the respective station instruction data present in the portable memory relative to the exercise to be performed by the user using the respective exercise apparatus unit collocated with the respective station and for receiving as output from the respective second processor performance data relative to an exercise completed by the user using the respective exercise apparatus unit collocated with the respective station;

said first processing means being arranged to modify said instruction data in reaction to said performance data output, as transferred to said first processor by removable association of said portable medium with said first bi-directional data transfer means; and said portable medium being arranged to be operatively and physically disconnected from said first bi-directional data transfer means when operationally removably associated with any second bi-directional data transfer means, and to be operationally and physically disconnected from all said second bi-directional data transfer means when operationally removably associated with said first bi-directional data transfer means.

2. The system of claim 1, wherein:

at least one of said exercise apparatus units is operatively associated with the respective said station and arranged to be electronically programmed instruction by data received as input to the respective second bi-directional data transfer means from the portable memory, and including means for detecting at least one variable of exercise interaction with the user from the exercise performed by the user at the respective site, for provision as performance output via the respective said bi-directional data transfer means to the portable memory.

3. The system of claim 1, wherein:

said portable memory comprises an $E^2$PROM.

4. The system of claim 1, wherein:

said portable medium comprises a waterproof cover enclosing said portable memory; and said portable memory is arranged to be programmed by magnetic induction by said first and second bi-directional data transfer means.

5. The system of claim 1, further including:

a manual data entry means operatively associated with said central unit, for supplying said first processing means, and thereby said first bi-directional data transfer means with personal and instruction data about said user for personalizing said program.

6. The system of claim 1, further including:

at least one of said station having operatively associated therewith a manual data entry means, for supplying the respective said second processing means, and thereby the respective said second bi-directional data transfer means with data about an exercise performed by the user using the respective exercise apparatus unit.

* * * * *